US010122104B2

(12) United States Patent
Koike et al.

(10) Patent No.: US 10,122,104 B2
(45) Date of Patent: Nov. 6, 2018

(54) CONNECTOR FOR A FLEXIBLE PRINTED CIRCUIT

(71) Applicant: SMK Corporation, Tokyo (JP)

(72) Inventors: Satoki Koike, Kanagawa (JP); Kiyoshi Asai, Kanagawa (JP); Tomohito Okamura, Ibaraki (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/628,597

(22) Filed: Jun. 20, 2017

(65) Prior Publication Data

US 2018/0076543 A1 Mar. 15, 2018

(30) Foreign Application Priority Data

Sep. 15, 2016 (JP) ..... 2016-180354

(51) Int. Cl.
*H01R 13/627* (2006.01)
*H01R 12/70* (2011.01)
*H01R 12/77* (2011.01)

(52) U.S. Cl.
CPC ..... *H01R 12/7011* (2013.01); *H01R 12/7064* (2013.01); *H01R 12/775* (2013.01); *H01R 12/777* (2013.01)

(58) Field of Classification Search
CPC .... H01R 23/684; H01R 12/79; H01R 12/592; H01R 13/6275
USPC ..... 439/260, 492–495, 350
See application file for complete search history.

(56) References Cited

U.S. PATENT DOCUMENTS 6,949,316 B2 * 9/2005 Aoki ..... H01R 12/771 439/260
7,399,193 B1 * 7/2008 Ho ..... H01R 13/62988 439/260
8,172,592 B2 * 5/2012 Ogura ..... H01R 12/79 439/260
8,272,889 B2 * 9/2012 Matoba ..... H01R 12/88 439/260
8,382,504 B2 * 2/2013 Matoba ..... H01R 12/88 439/350

(Continued)

FOREIGN PATENT DOCUMENTS

JP S6455687 U 4/1989
JP 2006085928 A 3/2006
JP 2013134807 A 7/2013

OTHER PUBLICATIONS

Office Action issued for counterpart Japanese Application 2016-180354, issued by the Japan Patent Office on Jul. 10, 2018.

*Primary Examiner* — Thanh Tam Le

(57) ABSTRACT

A lock part for locking an inserted state of a flexible printed circuit (FPC) is provided, in a housing of a connector, on both sides of an insertion portion in a width direction. Each lock part has an arm portion and a projected portion formed on an inner side portion of the arm portion in the width direction and is protruded into the insertion portion. The arm portion has a cantilever shape with a stationary end and a free end and extends, in a depth direction, to the free end from an insertion side portion on an FPC insertion side, and can be elastically deflected outward in the width direction. The projected portion has tilted portions tilted relative to the depth direction toward the free end and the insertion side portion, and is detachably engaged with a notch on a side of the inserted FPC in the width direction.

5 Claims, 18 Drawing Sheets

(56) References Cited

U.S. PATENT DOCUMENTS

| | | | | |
|---|---|---|---|---|
| 8,512,058 | B2 * | 8/2013 | Ozeki | H01R 12/772<br>439/260 |
| 2012/0164882 | A1 | 6/2012 | Ozeki | |

* cited by examiner

CONNECTOR FOR A FLEXIBLE PRINTED CIRCUIT

CROSS REFERENCE TO RELATED APPLICATION

The contents of the following Japanese patent application are incorporated herein by reference, Japanese Patent Application No. 2016-180354 filed on Sep. 15, 2016.

FIELD

The present invention relates to connectors and in particular, to a connector for a flexible printed circuit (FPC).

BACKGROUND

Connectors have been used to connect the connection terminal of a conductor trace included in a flexible printed circuit to the connection terminal of a conductor trace in another printed circuit.

In general, a connector of this type includes a housing having an insertion portion into which the connection end portion of the flexible printed circuit is inserted, and a plurality of contacts arrayed and supported in the housing. Inserting the flexible printed circuit into the insertion portion causes the connection terminals of the flexible printed circuit to be brought into contact with the contacting portions of the contacts.

Furthermore, the contact has a connection portion to be connected, for example, by soldering to the connection terminals of the conductor traces of another printed circuit such as a rigid printed circuit. This configuration enables the connection terminals of the conductor traces of a flexible printed circuit and the connection terminals of the conductor traces of another printed circuit to be connected to each other via the contacts of the connector.

However, the flexible printed circuit is less in strength than the rigid printed circuit, and may be damaged due to the repetition of insertion and extraction of the flexible printed circuit into/from the connector. In this context, such a structure as a Zero Insertion Force (ZIF) structure has been used which enables insertion and extraction of the flexible printed circuit without applying an excessive force in the direction of the insertion and extraction at the time of the insertion and extraction (for example, see Patent Literature 1).

Disclosed in Patent Literature 1 is a connector configured such that a notch engagement portion on a side surface of a flexible printed circuit having been inserted into a housing is engaged with an engagement part provided on an electrically conductive shell. There is provided a disengagement portion as an actuator on the upper portion of the electrically conductive shell, and pressing the operation portion allows for releasing the engagement state of the flexible printed circuit by the engagement part.

CITATION LIST

Patent Literature

Patent Literature 1: Japanese Patent No. 5093340

SUMMARY

Technical Problem

However, in the case of the connector disclosed in Patent Literature 1, an operation of releasing the engagement or depressing the operation portion was required in order to extract the flexible printed circuit. When the flexible printed circuit was extracted without the operation of releasing the engagement, the flexible printed circuit and the engagement part could be damaged. Furthermore, the operation portion for moving the disengagement portion was provided on the upper portion of the electrically conductive shell, which caused an impediment to the reduction in height of the connector.

The present invention has been made in view of the problems mentioned above, and an object of the invention is to provide a connector which facilitates insertion and extraction of a flexible printed circuit and enables the connector to be reduced in height without damaging the flexible printed circuit and a lock part on the connector side at the time of the insertion and extraction.

Solution to Problem

In order to achieve the aforementioned object, a connector according to a first aspect of the present invention includes: a housing having an insertion portion into which a flexible printed circuit is inserted; and a contact having a contacting portion to be in contact with a connection terminal of the flexible printed circuit having been inserted into the insertion portion. In the connector, a lock part for locking an inserted state of the flexible printed circuit having been inserted into the insertion portion is provided in the housing on both sides of the insertion portion in a width direction, and each of the lock parts has an arm portion and a projected portion which is formed on an inner side portion of the arm portion in the width direction and protruded into the insertion portion, where the arm portion has a cantilever shape with a stationary end and a free end, extends, in a depth direction orthogonal to the width direction, to the free end from an insertion side portion on a side from which the flexible printed circuit is inserted, and can be elastically deflected outward in the width direction. The projected portion has a tilted portion toward the free end and a tilted portion toward the insertion side portion, the tilted portions being tilted relative to the depth direction, and is detachably engaged with a notch provided on a side of the flexible printed circuit in the width direction when the flexible printed circuit is an inserted state.

As described above, the connector is configured such that the arm portion of the lock part has a cantilever shape having the stationary end and the free end and extends, in the depth direction orthogonal to the width direction, to the free end from the insertion side portion on the side from which the flexible printed circuit is inserted. The arm portion can be elastically deflected outward in the width direction. The projected portion which is formed on an inner side portion of the arm portion and protruded into the insertion portion has the tilted portion toward the free end and the tilted portion toward the insertion side portion, the tilted portions being tilted relative to the depth direction.

Thus, applying a force to the flexible printed circuit in the direction of insertion and extraction of the flexible printed circuit at the time of the insertion and extraction causes the arm portion to be deflected outward in the width direction by the tilted portion toward the free end or the tilted portion toward the insertion side portion of the projected portion formed on the arm portion, thereby facilitating insertion and extraction of the flexible printed circuit.

This eliminates the necessity of an additional operation for releasing an engagement state (hereafter also referred to as the lock release operation) disclosed in Patent Literature 1. Therefore, the flexible printed circuit and a lock part on the connector side will never be damaged even by performing an extraction operation without performing the lock release operation.

Furthermore, since the lock release operation as disclosed in Patent Literature 1 is not required, an operation portion for a lock release portion needs not to be provided on the upper portion of the connector, thereby enabling the connector to be reduced in height.

As described above, the aforementioned configuration of the first aspect of the present invention facilitates insertion and extraction of the flexible printed circuit and enables the connector to be reduced in height without damaging the flexible printed circuit and a lock part on the connector side at the time of the insertion and extraction.

Furthermore, the connector according to a second aspect of the present invention may also be configured such that the arm portion is curved in a U shape at the insertion side portion.

This configuration enables a stationary portion of the lock part to be disposed at a desired position in the depth direction, while ensuring the deflection elasticity of the arm portion, by adjusting the length from the insertion side portion to the stationary end.

Furthermore, the connector according to a third aspect of the present invention is preferably configured such that a tilt angle of the tilted portion toward the free end relative to the depth direction is greater than a tilt angle of the tilted portion toward the insertion side portion.

This configuration enables the force required at the time of extraction of the flexible printed circuit to be greater than the force required at the time of insertion. This implements a configuration which makes it easy to insert and hard to extract the flexible printed circuit.

Furthermore, the connector according to a fourth aspect of the present invention is preferably configured such that both the lock parts have outer shapes that are symmetric to each other.

This configuration allows for manufacturing both the lock parts by the same manufacturing facility, thereby reducing manufacturing costs.

Furthermore, the connector according to a fifth aspect of the present invention may also be configured such that both the lock parts are made of a metal.

This configuration provides an increased strength for the lock part, so that the lock part will resist damage even when the insertion and extraction of the flexible printed circuit are repeated.

Furthermore, the connector according to a sixth aspect of the present invention may also be configured such that the flexible printed circuit is reinforced by a metal plate including at least the notch.

This configuration allows the flexible printed circuit to resist damage caused by the insertion and extraction of the flexible printed circuit.

According to an aspect of the present invention, it is possible to provide a connector which facilitates insertion and extraction of a flexible printed circuit and allows the connector to be reduced in height without damaging the flexible printed circuit and the lock part on the connector side at the time of the insertion and extraction.

BRIEF DESCRIPTION OF DRAWINGS

FIG. 1A is a schematic perspective view when viewed from an upper front side.

FIG. 1B is a schematic perspective view when viewed from a lower rear side.

FIG. 7A is a schematic perspective when viewed from above.

FIG. 7B is a schematic perspective view when viewed from below.

DESCRIPTION OF EMBODIMENTS

A connector according to an embodiment of the present invention will now be described with reference to the drawings.

Figure 1A:
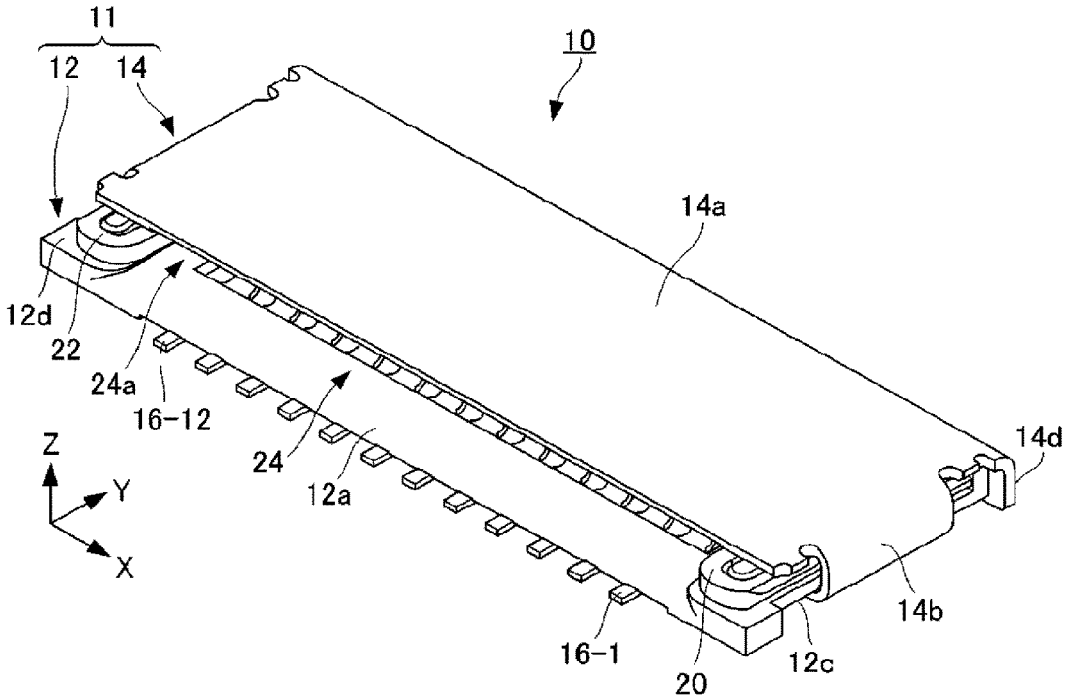
FIG. 1A is a view illustrating a connector according to an embodiment of the present invention where
Figure 1B:
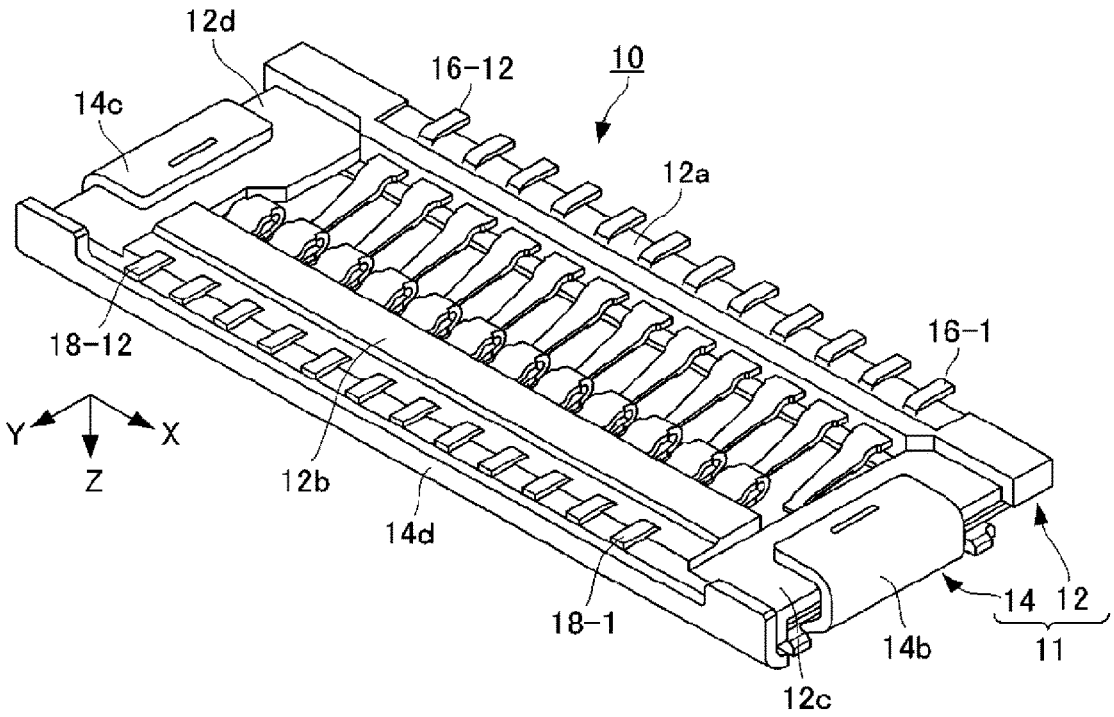
FIG. 1B is a view illustrating the connector according to the embodiment of the present invention where

FIG. 1A is a schematic perspective view illustrating a connector 10 according to the embodiment of the present invention when viewed from an upper front side, and FIG. 1B is a schematic perspective view when viewed from a lower rear side.

As illustrated in FIGS. 1A and 1B, the connector 10 includes a housing 11 having an insertion portion 24 into which a flexible printed circuit 30 is inserted, and contacts 16-1, . . . , and 16-12 and 18-1, . . . , and 18-12 (hereafter simply referred to as, for example, the contacts 16 and 18). As will be detailed later, the contacts 16 and 18 have contacting portions 16*a* and 18*a* which are in elastic contact with connection terminals 36 and 38 of the flexible printed circuit 30 having been inserted into the insertion portion 24.

The housing 11 includes a resin frame 12 that supports the plurality of contacts 16 and 18, and a metallic cover 14 that partially covers the frame 12, with the insertion portion 24 formed between the frame 12 and the cover 14.

The frame 12 has a first frame 12*a* and a second frame 12*b* which, with a gap therebetween, extend in the width direction (in the X-axis direction), and a third frame 12*c* and a fourth frame 12*d* which extend in the depth direction (in the Y-axis direction) so as to couple the first frame 12*a* and the second frame 12*b* together at both ends in the width direction. The frame 12 has, as an opening, an inside portion surrounded by the first to fourth frames 12*a* to 12*d* in the shape of a generally rectangular frame.

The cover 14, which is made of a metal, has an upper plate portion 14*a* that covers part or all of the upper side of the frame 12, mounting portions 14*b* and 14*c* that are bent so as to be secured to the third frame 12*c* and the fourth frame 12*d*, respectively, and a rear plate portion 14*d* bent rearward. The cover 14 functions as an electromagnetic shield to interrupt electromagnetic noise and adjust the characteristic impedance of signal conductor traces.

In place of the metallic cover 14, a resin cover may also be employed as required, and in the case of the resin cover, it may also be molded integrally with the frame 12.

Figure 2A:
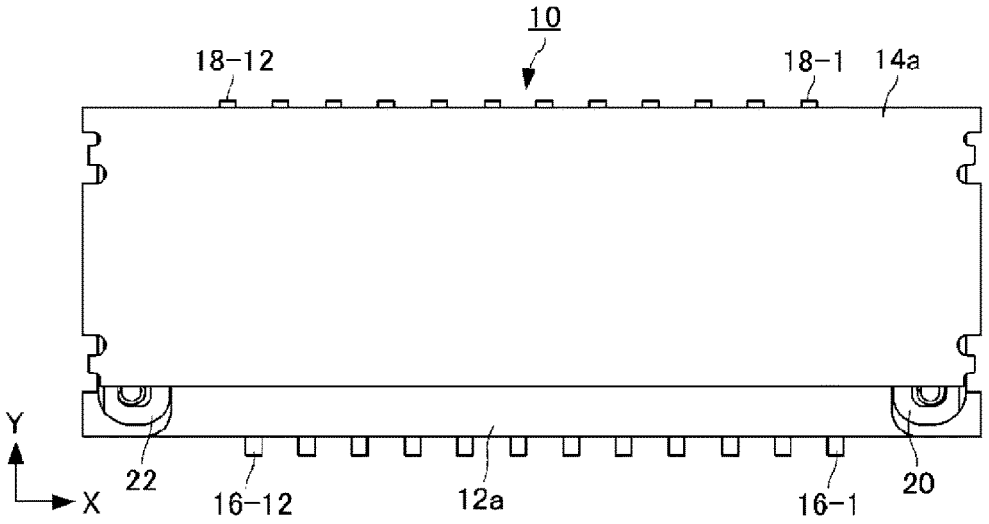
FIG. 2A is a plan view illustrating the connector according to the embodiment of the present invention.
Figure 2B:
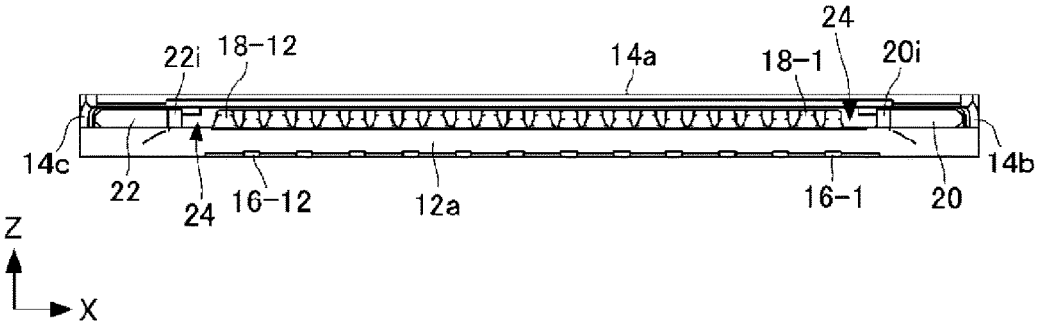
FIG. 2B is a front view illustrating the connector according to the embodiment of the present invention.
Figure 2C:
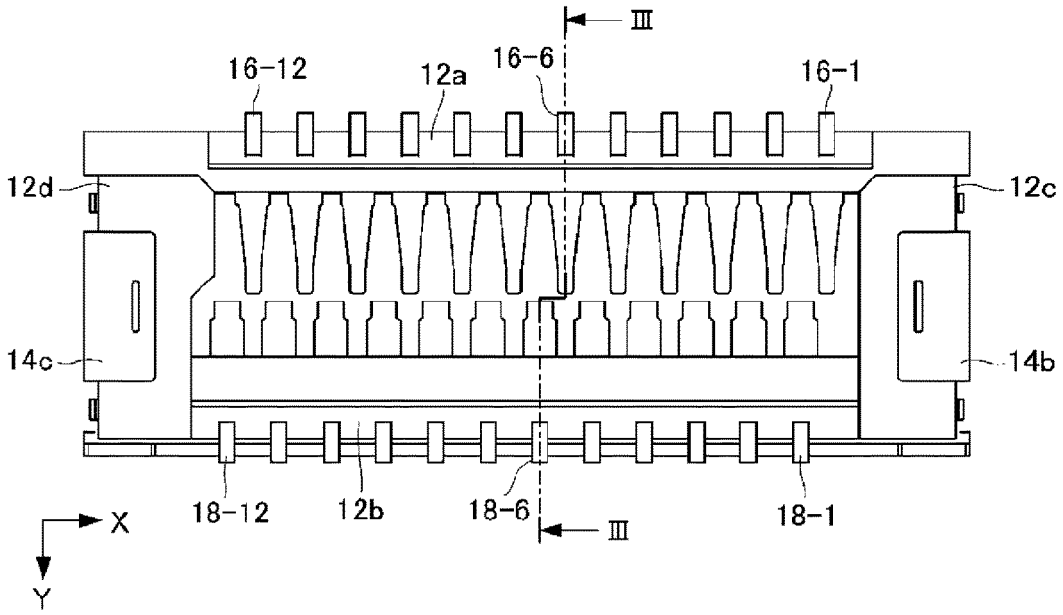
FIG. 2C is a bottom view illustrating the connector according to the embodiment of the present invention.

FIG. 2A is a plan view illustrating the connector 10, FIG. 2B is a front view thereof, and FIG. 2C is a bottom view thereof.

As illustrated in FIG. 2C, the twelve first type contacts 16-1, . . . , and 16-12 having the same shape are arrayed to be mounted to the first frame 12*a* at regular intervals, and the other twelve second type contacts 18-1, . . . , and 18-12 having the same shape are arrayed to be mounted to the second frame 12*b* at regular intervals. The contacts 16-1, . . . , and 16-12 mounted to the first frame 12*a* and the contacts 18-1, . . . , and 18-12 mounted to the second frame 12*b* are alternately disposed in a staggered arrangement in the width direction (in the X-axis direction). The contacts 16 and 18 are made of a metal, for example, phosphor bronze.

In this embodiment, two arrays of contacts are arranged with twelve contacts in each array. However, the number of contacts and the number of arrays are not limited thereto, and any number of contacts and arrays may also be employed. To increase the number of arrays, a frame extending in the width direction may be additionally provided.

Figure 3:
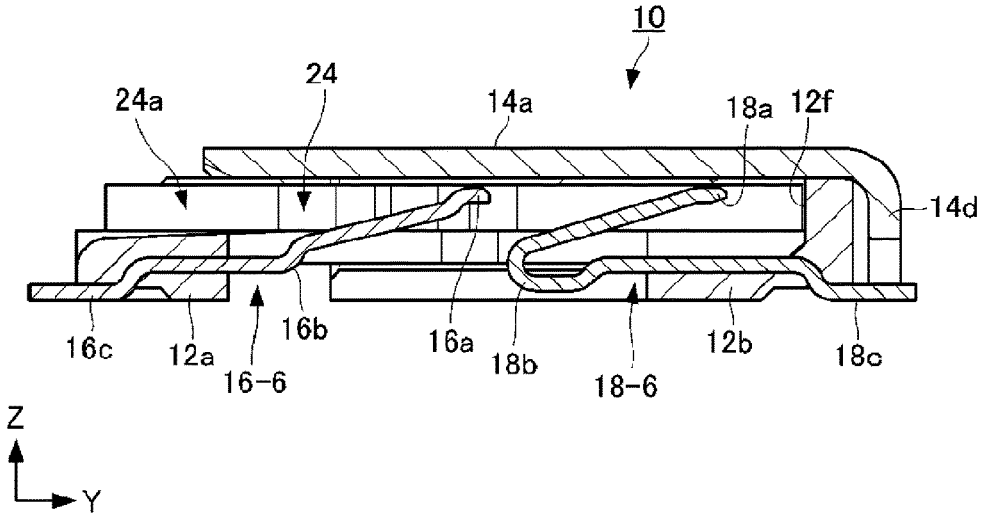
FIG. 3 is a cross-sectional view taken along line of FIG. 2C.

FIG. 3 is a cross-sectional view taken along line of FIG. 2C.

As illustrated in FIG. 3, the first type contact 16 is a plate-shaped member that has a contacting portion 16*a*, a bent portion 16*b*, and a connection terminal portion 16*c*. The contacting portion 16*a* is configured to be in elastic contact with the connection terminal 36 of the flexible printed circuit 30 having been inserted into the insertion portion 24 (see FIG. 9). The bent portion 16*b* protrudes the contacting portion 16*a* into the insertion portion 24 and is provided with such an appropriate elasticity that allows the contacting portion 16*a* to be deflected downward. The connection terminal portion 16*c* is protruded forward from the first frame 12*a* and is configured to be connected, for example, by soldering to the connection terminal of a conductor trace of another printed circuit.

Furthermore, the second type contact 18 is a plate-shaped member which has a contacting portion 18*a*, a bent portion 18*b*, and a connection terminal portion 18*c*. The contacting portion 18*a* is configured to be in elastic contact with the connection terminal 38 of the flexible printed circuit 30 having been inserted into the insertion portion 24 (see FIG. 9). The bent portion 18*b* allows the contact body to be folded so as to protrude the contacting portion 18*a* into the insertion portion 24 and the contacting portion 18*a* to be deflected downward with an appropriate elasticity. The connection terminal portion 18*c* is protruded rearward from the second frame 12*b* and configured to be connected, for example, by soldering to the connection terminal of a conductor trace of another printed circuit.

Figure 4:
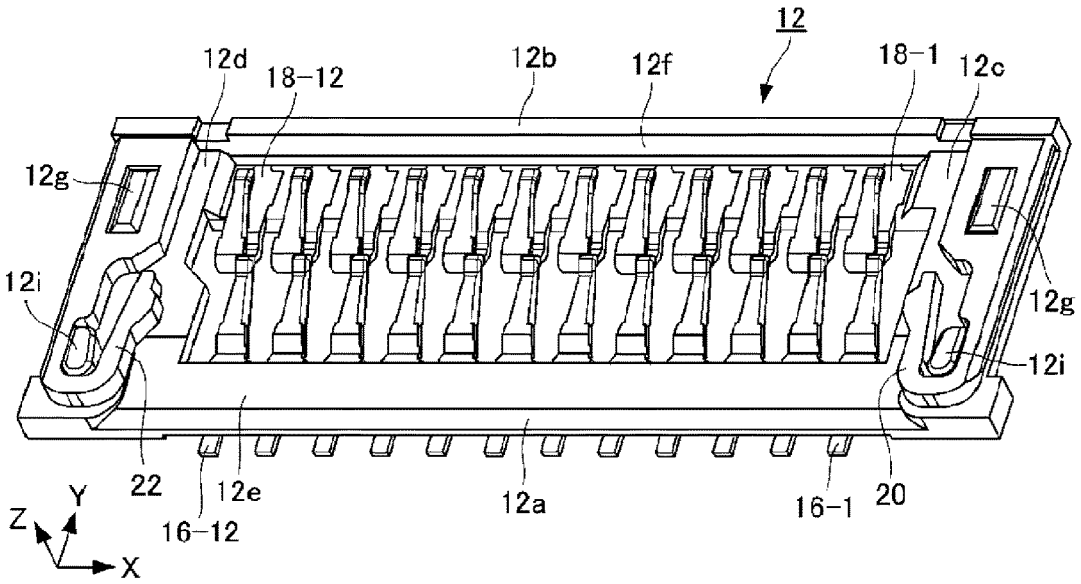
FIG. 4 is an explanatory perspective view illustrating the connector with a cover removed.

FIG. 4 is an explanatory perspective view illustrating the connector 10 with the cover 14 removed.

As illustrated in FIG. 4, lock parts 20 and 22 for locking the inserted state of the flexible printed circuit 30 having been inserted into the insertion portion 24 are provided on respective sides of the insertion portion 24 in the housing 11 in the width direction (in the X-axis direction).

As illustrated in FIG. 4, both the lock parts 20 and 22 have outer shapes that are symmetric to each other. Therefore, the lock part 20 on the right in the figure can be inverted to be used as the lock part 22 on the left in the figure.

Both the lock parts 20 and 22 are made of a metal, and manufactured, for example, by punching a metal plate. In place of the metallic lock parts 20 and 22, a resin lock part may also be employed.

On the other hand, the thickness in a height direction (in the Z-axis direction) of the lock parts 20 and 22 is greater than that of the flexible printed circuit 30 in order to hold the flexible printed circuit 30 with stability.

Figure 5:
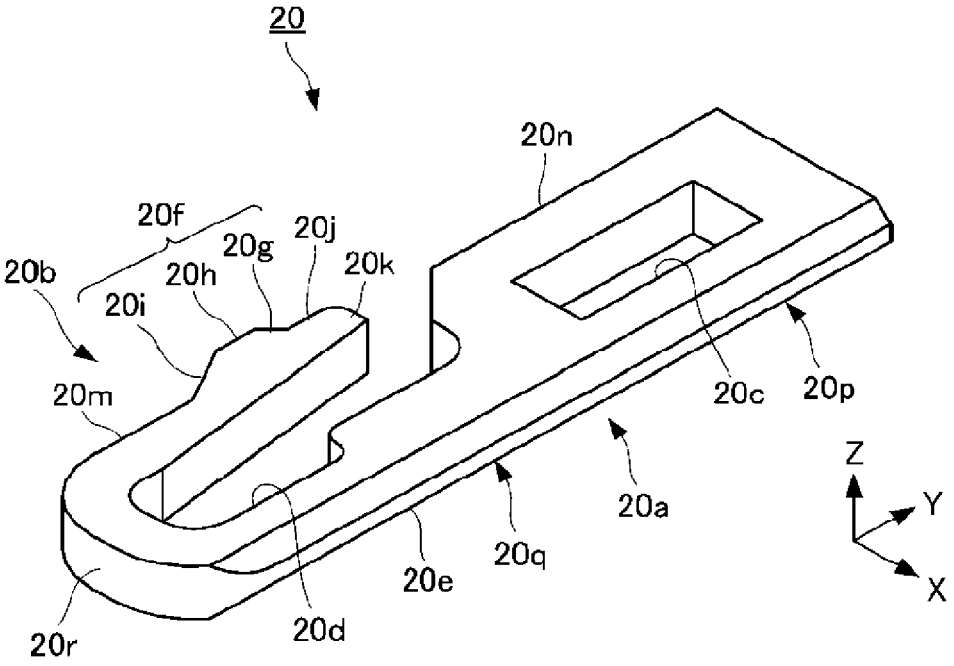
FIG. 5 is a perspective view illustrating a lock part according to the embodiment of the present invention.
Figure 6:
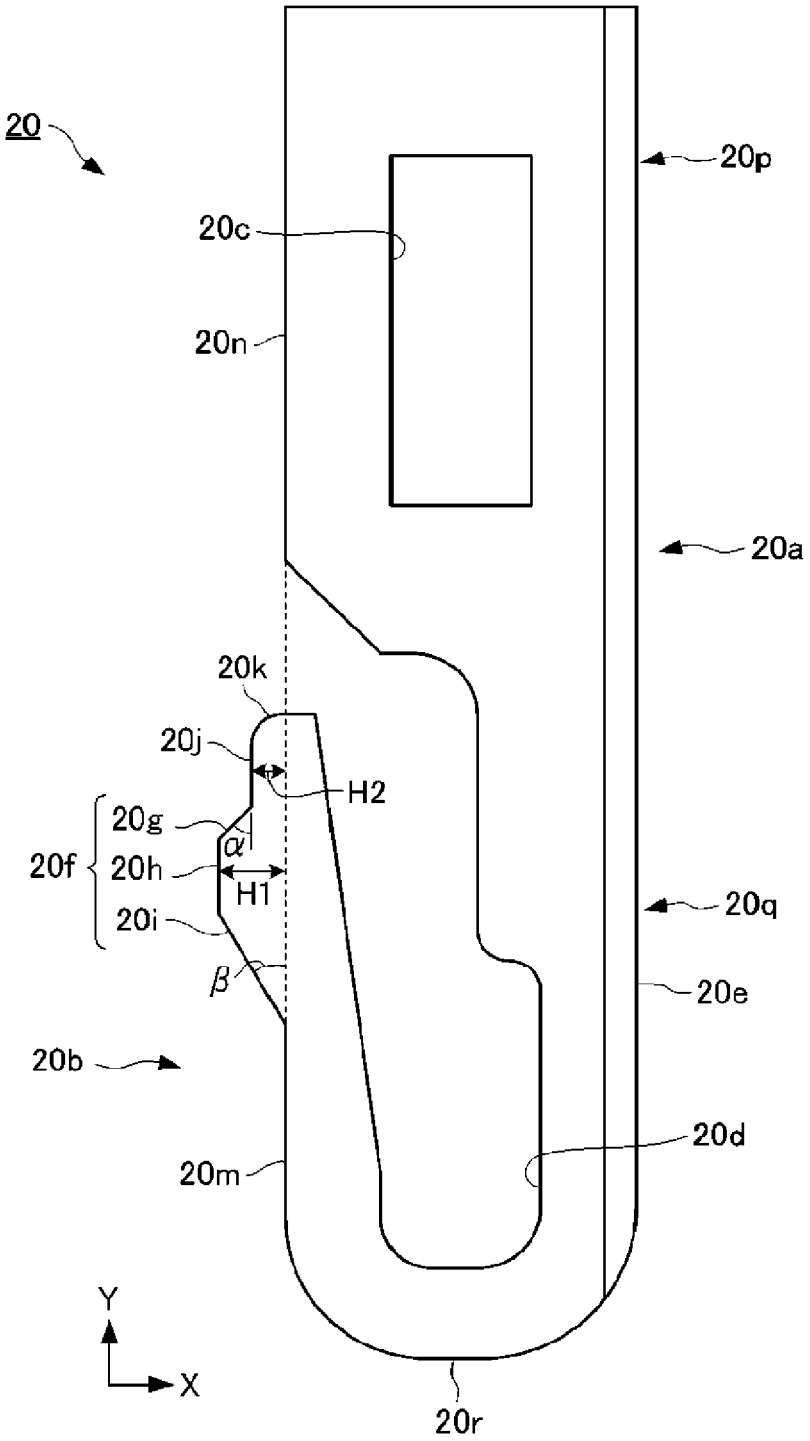
FIG. 6 is a plan view illustrating the lock part according to the embodiment of the present invention.

FIG. 5 is a perspective view illustrating the lock part 20, and FIG. 6 is a plan view thereof.

The lock part 20 has a stationary portion 20*a* and a cantilever spring-shaped arm portion 20*b*, which are integrally formed.

The stationary portion 20*a* has a wide portion 20*p* increased in width in the width direction (in the X-axis direction) and a subsequent narrow portion 20*q* reduced in width. The wide portion 20*p* of the stationary portion 20*a* has a hole 20*c* formed to allow a projection 12*g* to be fitted therein, the projection 12*g* being rectangular in plan view and provided on the upper surface of the third frame 12*c*. This arrangement allows the stationary portion 20*a* to be secured to the third frame 12*c*.

Furthermore, on the inner side of the wide portion 20*p* of the stationary portion 20*a* in the width direction (in the X-axis direction), formed is a guide portion 20*n* having a side surface parallel to the depth direction (the Y-axis direction). The guide portion 20*n* is configured to guide the movement of the flexible printed circuit 30 in the depth direction when being inserted into the insertion portion 24.

There is provided a stationary end 20*e* of the arm portion 20*b* integrally coupled to the narrow portion 20*q* of the stationary portion 20*a*. The arm portion 20*b* extends in an opposite direction to the depth direction (in the Y-axis direction) from the stationary end 20*e* and is then curved in a U shape and folded at an insertion side portion 20*r* on the side from which the flexible printed circuit 30 is inserted.

More specifically, the lock part 20 has the arm portion 20*b* and a projected portion 20*f* which is formed on an inner side portion in the width direction of the arm portion 20*b* and is protruded into the insertion portion 24. The arm portion 20*b* has a cantilever shape with the stationary end 20*e* and a free end 20*k* and extends, in the depth direction (in the Y-axis direction) orthogonal to the width direction, to the free end 20*k* from the insertion side portion 20*r* on the side from which the flexible printed circuit 30 is inserted. The arm portion 20*b* can be elastically deflected outward in the width direction (in the X-axis direction).

Furthermore, the arm portion 20*b* has an inner recessed portion 20*d* curved in a U shape into which a projection 12*i* provided on the upper surface of the third frame 12*c* and formed in an elliptical shape in plan view is fitted. This configuration makes it possible to securely fix the lock part 20 by the third frame 12*c*.

This embodiment is configured to fit the projection 12*i* of the third frame 12*c* into the inner recessed portion 20*d* of the lock part. However, without being limited thereto, such a configuration as one with no projection 12*i* may also be employed.

When the projection 12*i* is available on the third frame 12*c* as in this embodiment, the arm portion 20*b* functions as a cantilever spring that is deflected with the insertion side portion 20*r* acting as the fulcrum. When no projection 12*i* is available on the third frame 12*c*, the arm portion 20*b* functions as a cantilever spring that is deflected with the stationary end 20*e* acting as the fulcrum.

Furthermore, as inner surfaces in the width direction (in the X-axis direction) of the arm portion 20*b*, formed are a flat portion 20*m* located toward the insertion side portion with respect to the projected portion 20*f* and a flat portion 20*j* located toward the free end with respect to the projected portion 20*f*. As illustrated in FIG. 6, the flat portion 20*m* toward the insertion side portion is generally flush with the side surface of the guide portion 20*n* and configured to function as a sideward guide at the time of insertion and extraction of the flexible printed circuit 30.

The flat portion 20*j* toward the free end is located more inward in the width direction than the guide portion 20*n* and the flat portion 20*m* toward the insertion side portion. That is, with respect to the position of the side surface of the guide portion 20*n* in the width direction (in the X-axis direction), the flat portion 20*j* is protruded inward in the width direction by a size H2. This enables the flat portion 20*j* to elastically press the side of the flexible printed circuit 30 when the flexible printed circuit 30 has been inserted into the insertion portion 24.

The projected portion 20*f* has a tilted portion 20*g* toward the free end and a tilted portion 20*i* toward the insertion side portion, the tilted portions 20*g* and 20*i* being tilted relative to the depth direction (the Y-axis direction), and is configured to be detachably engaged with a notch 40 provided on a side of the flexible printed circuit 30 in the width direction when the flexible printed circuit 30 is in an inserted state.

The tilt angle $\alpha$ of the tilted portion 20*g* toward the free end relative to the depth direction is greater than the tilt angle $\beta$ of the tilted portion 20*i* toward the insertion side portion. That is, it holds that $\alpha>\beta$.

Furthermore, the projected portion 20*f* has a flattened flat portion 20*h* between the tilted portion 20*g* toward the free end and the tilted portion 20*i* toward the insertion side portion, and is protruded inward in the width direction by a size H1 with respect to the position of the side surface of the guide portion 20*n* in the width direction (in the X-axis direction). Here, it holds that H1>H2.

Changing the tilt angles $\alpha$ and $\beta$ and the sizes H1 and H2 makes it possible to adjust the magnitude of force required at the time of insertion and extraction of the flexible printed circuit 30, that is, the magnitude of holding force for holding the flexible printed circuit 30.

The lock part 20, one of the lock parts, has been described above. Since both the lock parts 20 and 22 have shapes with the right and left sides inverted relative to each other, and the aforementioned description of the lock part 20 is applicable to the lock part 22, a detailed description of the lock part 22 will be omitted.

As illustrated in FIG. 2B, the insertion portion 24 into which the flexible printed circuit 30 is inserted has an inner space defined by both the lock parts 20 and 22, the first frame 12*a* and the second frame 12*b*, and the cover 14, and has an insertion portion opening 24*a* formed frontward in the depth direction (in the Y-axis direction).

In the insertion portion opening 24*a*, the upper surface of the first frame 12*a* is a tilted surface 12*e* that is lowered frontward in the depth direction so as to facilitate the insertion of the flexible printed circuit 30 (see FIG. 3). Furthermore, the second frame 12*b* is provided with a projected surface portion 12*f* that is protruded upward (see FIG. 4) and functions as a stopper in the depth direction when the flexible printed circuit 30 is inserted (see FIGS. 10A and 10B). The width, height, and depth of the insertion portion 24 is set as appropriate by taking into account the width, thickness, and depth of a connection end portion 33 of the flexible printed circuit 30 to be inserted.

Figure 7A:
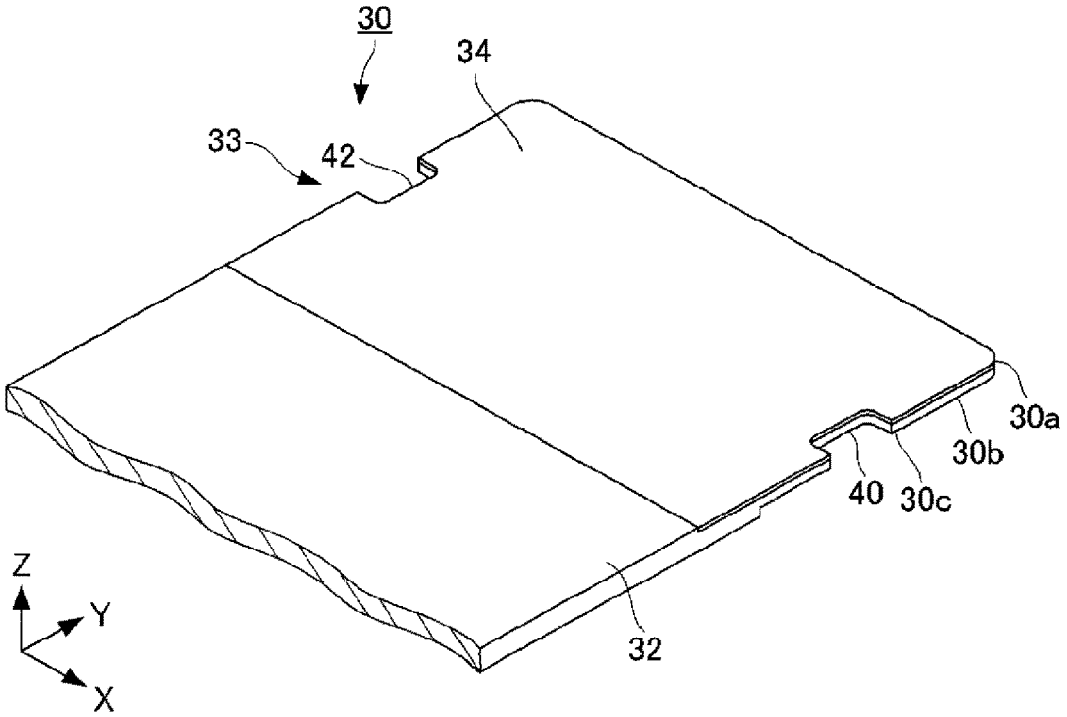
FIG. 7A is a view illustrating a flexible printed circuit to be inserted into the connector according to the embodiment of the present invention where
Figure 7B:
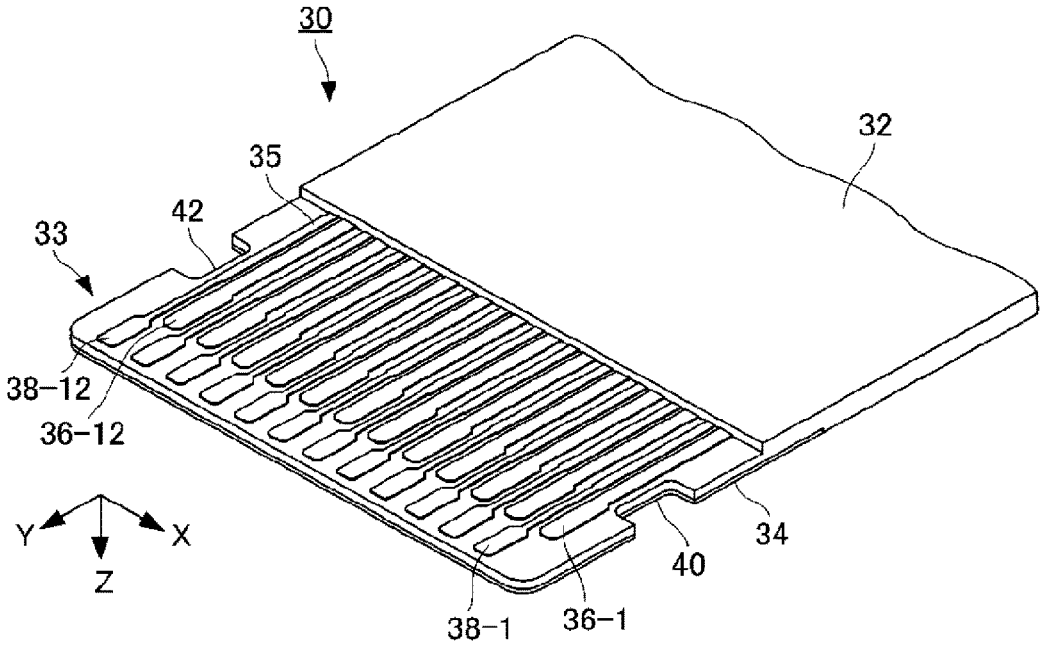
FIG. 7B is a view illustrating the flexible printed circuit to be inserted into the connector according to the embodiment of the present invention where

FIG. 7A is a schematic perspective view illustrating the flexible printed circuit 30 to be inserted into the connector 10 when viewed from above, and FIG. 7B is a schematic perspective view when viewed from below.

The flexible printed circuit 30 has a thin and flexible printed circuit body 32 made of, for example, an insulating plastic film, and a conductor trace section 35 formed of, for example, copper foil in the printed circuit body 32. Furthermore, the flexible printed circuit 30 includes the connection end portion 33 to be inserted into the insertion portion 24 of the connector 10 and thereby connected to conductor traces, for example, of another printed circuit. The flexible printed circuit 30 is not limited to a particular thickness, but for example, 0.15 mm in thickness.

As illustrated in FIG. 7B, in the connection end portion 33 of the flexible printed circuit 30, the connection terminals 36-1, . . . , and 36-12, and 38-1, . . . , and 38-12 (hereafter simply referred to as, for example, the connection terminals 36 and 38) of the conductor trace section 35 are exposed so as to be in contact with the contacting portions 16*a* and 18*a* of the contacts 16 and 18, respectively. The notches 40 and 42 which are generally rectangular in plan view are formed on the respective sides of the connection end portion 33 in the width direction.

Furthermore, the flexible printed circuit 30 is configured such that the connection end portion 33 including at least the notches 40 and 42 is reinforced by a metal plate 34. The metal plate 34 is not limited to a particular thickness, but for example, 0.05 mm in thickness.

Figure 8:
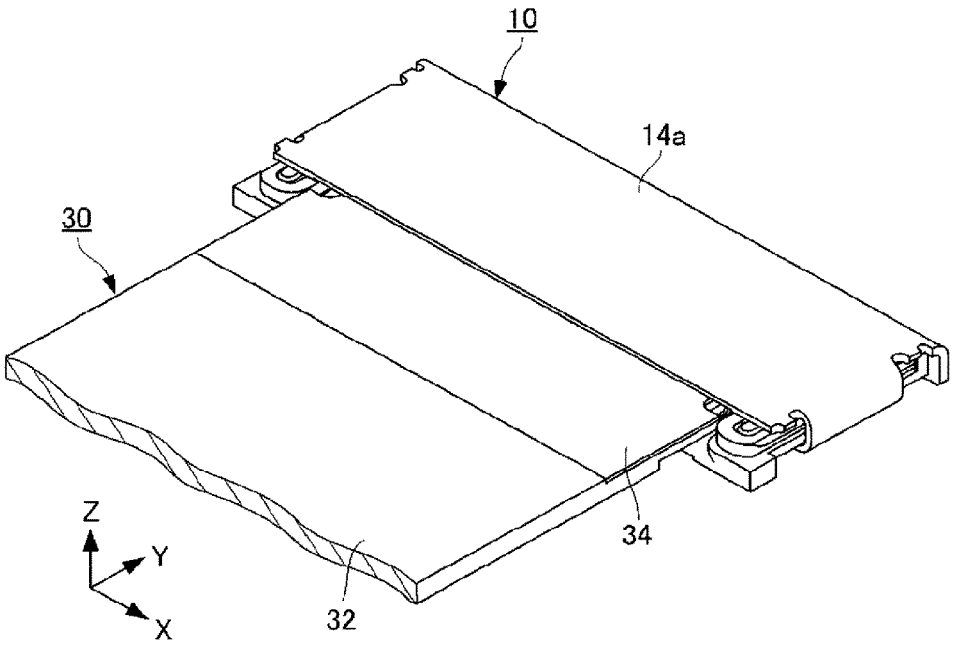
FIG. 8 is a schematic perspective view illustrating the flexible printed circuit having been inserted into the connector according to the embodiment of the present invention.
Figure 9:
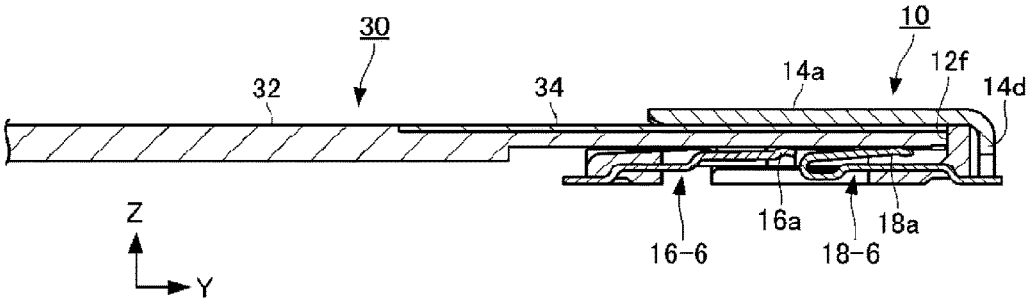
FIG. 9 is a view illustrating the flexible printed circuit having been inserted into the connector as a cross-sectional view corresponding to the cross-sectional view taken along line of FIG. 2C.
Figure 10A:
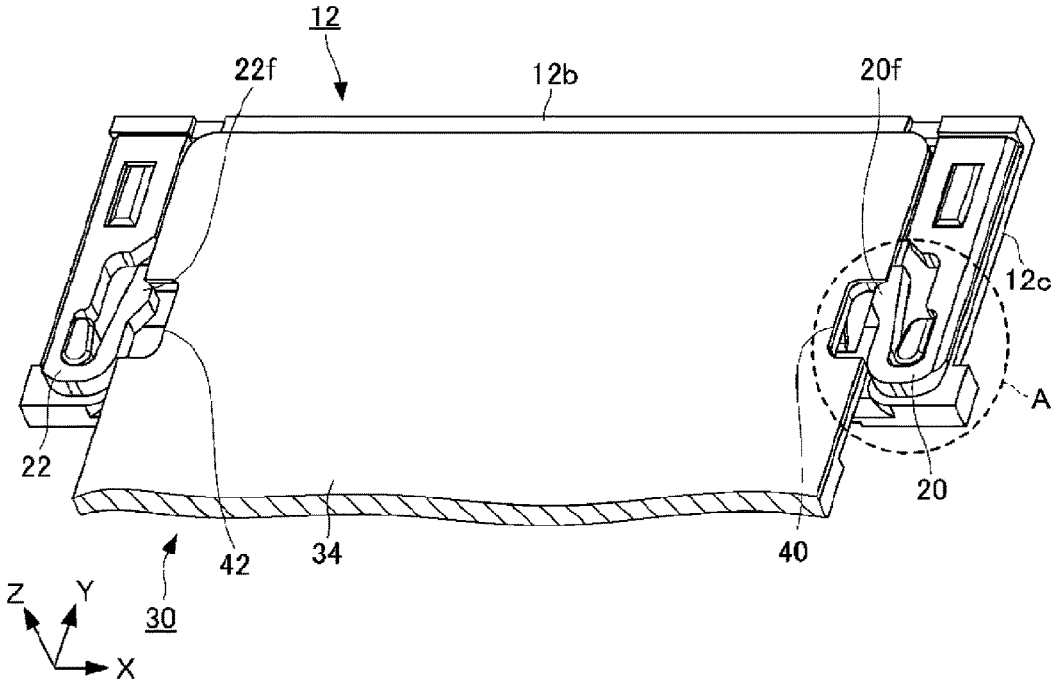
FIG. 10A is an explanatory perspective view illustrating the flexible printed circuit having been inserted into the connector when viewed with the cover removed for purposes of illustration.
Figure 10B:
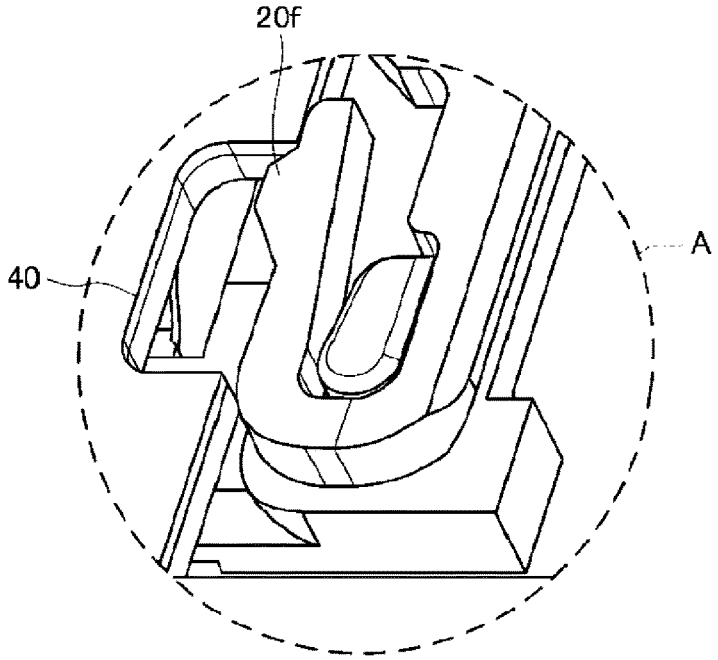
FIG. 10B is an enlarged figure of the part A in FIG. 10A.

FIG. 8 is a schematic perspective view illustrating the flexible printed circuit 30 having been inserted into the connector 10, FIG. 9 is a cross-sectional view corresponding to a cross-sectional view taken along line of FIG. 2C in an inserted state, and FIG. 10A is an explanatory perspective view in an inserted state with the cover 14 removed for purposes of illustration.

As illustrated in FIGS. 8 to 10B, with the flexible printed circuit 30 having been inserted into the insertion portion 24, the projected portions 20*f* and 22*f* of both the lock parts 20 and 22 are fitted into the notches 40 and 42 on both the sides of the flexible printed circuit 30, respectively, so that the flexible printed circuit 30 is elastically sandwiched by both the lock parts 20 and 22, and thus the inserted state is locked.

Now, a description will be made to the insertion and extraction of the flexible printed circuit 30.

FIGS. 11A to 11D are each an explanatory view illustrating changes in the state of the lock part 20 at the time of insertion of the flexible printed circuit 30.

Figure 11A:
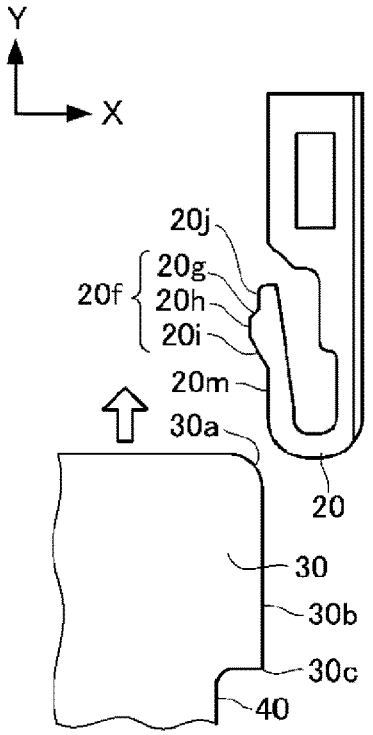
FIG. 11A is an explanatory view illustrating changes in the state of the lock part at the time of insertion of the flexible printed circuit.

As illustrated in FIG. 11A, the flexible printed circuit 30 is inserted into the insertion portion 24 through the insertion portion opening 24*a* of the connector 10. First, while being guided along the flat portion 20*m* of the lock part 20, the flexible printed circuit 30 is moved in the depth direction (in the Y-axis direction). The flat portion 20*m* restricts the movement of the flexible printed circuit 30 in the width direction (in the X-axis direction).

Figure 11B:
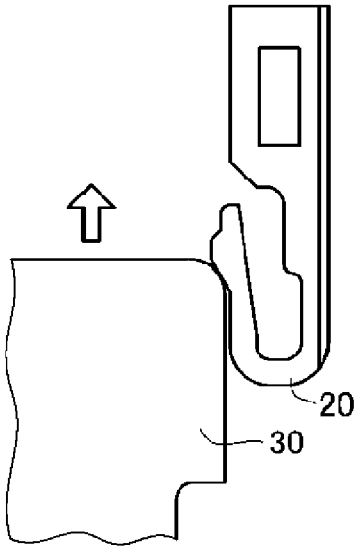
FIG. 11B is an explanatory view illustrating changes in the state of the lock part at the time of insertion of the flexible printed circuit.
Figure 11C:
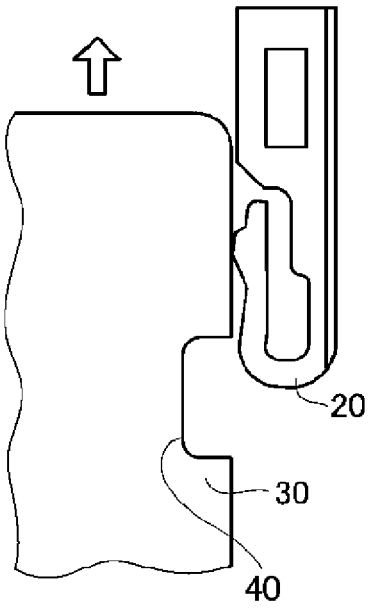
FIG. 11C is an explanatory view illustrating changes in the state of the lock part at the time of insertion of the flexible printed circuit.

Then, as illustrated in FIG. 11B, while a top corner portion 30*a* of the flexible printed circuit 30 is in contact with the tilted portion 20*i* toward the insertion side portion of the projected portion 20*f* of the lock part 20, the arm portion 20*b* is deflected outward in the width direction (in the X-axis direction). Furthermore, while a side surface portion 30*b* of the flexible printed circuit 30 is in contact with the projected portion 20*f*, with the arm portion 20*b* deflected outward in the width direction, the flexible printed circuit 30 is moved in the depth direction (in the Y-axis direction) (see FIG. 11C).

Figure 11D:
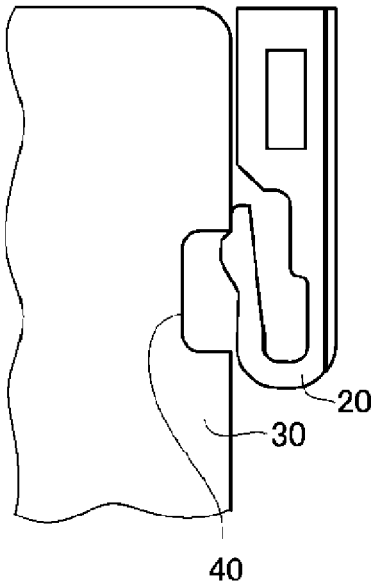
FIG. 11D is an explanatory view illustrating changes in the state of the lock part at the time of insertion of the flexible printed circuit.

When the flexible printed circuit 30 has reached a predetermined insertion position, the projected portion 20*f* is fitted into the notch 40 formed on the side of the flexible printed circuit 30 so that the inserted state is locked (see FIG. 11D). At this time, the arm portion 20*b* is slightly deflected outward in the width direction, and thus presses the side of the flexible printed circuit 30 inward in the width direction. That is, both the lock parts 20 and 22 elastically sandwich the flexible printed circuit 30.

At this stage, the insertion of the flexible printed circuit 30 is completed.

FIGS. 12A to 12D are each an explanatory view illustrating changes in the state of the lock part 20 at the time of extraction of the flexible printed circuit 30.

Figure 12A:
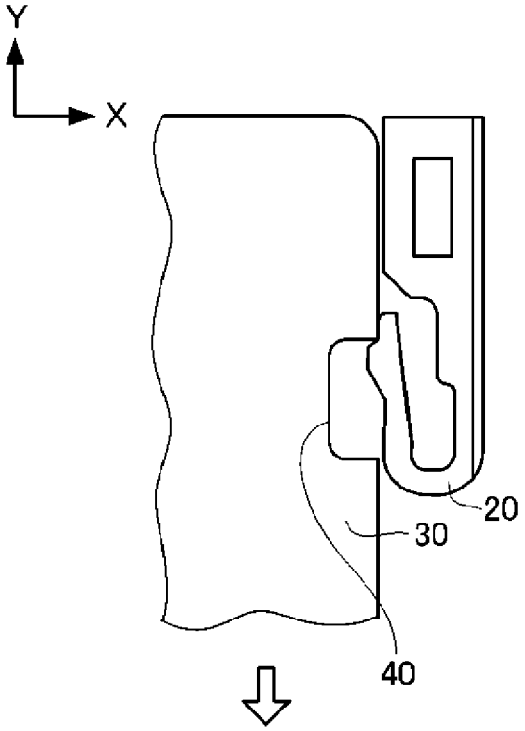
FIG. 12A is an explanatory view illustrating changes in the state of the lock part at the time of extraction of the flexible printed circuit.
Figure 12B:
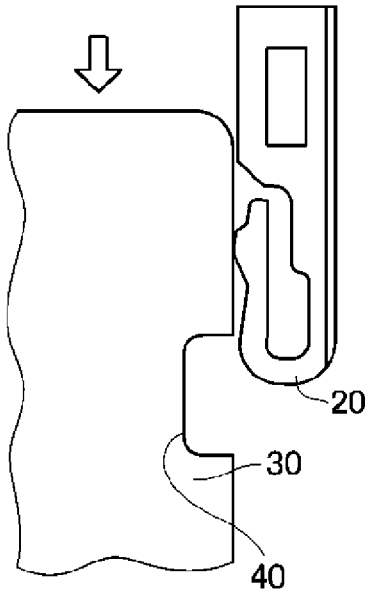
FIG. 12B is an explanatory view illustrating changes in the state of the lock part at the time of extraction of the flexible printed circuit.
Figure 12C:
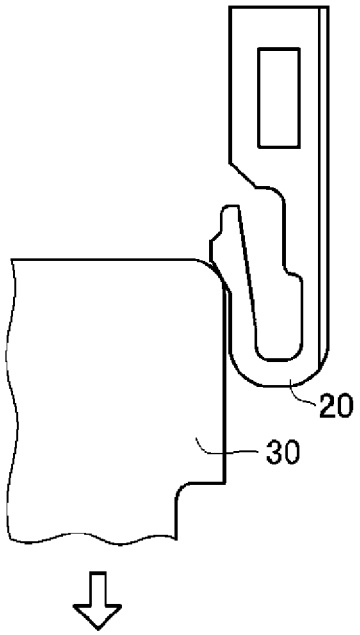
FIG. 12C is an explanatory view illustrating changes in the state of the lock part at the time of extraction of the flexible printed circuit.

As illustrated in FIG. 12A, with the flexible printed circuit 30 having been inserted into the insertion portion 24, force is applied to the flexible printed circuit 30 in the extraction direction (opposite in the Y-axis direction) so as to deflect the arm portion 20*b* outward in the width direction while a corner 30*c* of the notch 40 is in contact with the tilted portion 20*g* toward the free end of the projected portion 20*f* of the lock part 20. Furthermore, while the side surface portion 30*b* of the flexible printed circuit 30 is in contact with the projected portion 20*f*, with the arm portion 20*b* deflected outward in the width direction, the flexible printed circuit 30 is moved in the extraction direction (see FIG. 12B).

Figure 12D:
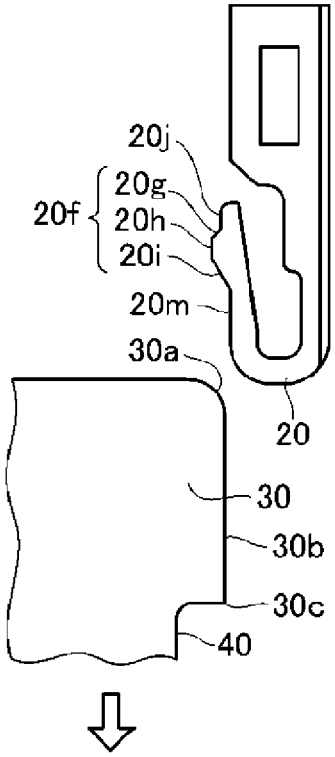
FIG. 12D is an explanatory view illustrating changes in the state of the lock part at the time of extraction of the flexible printed circuit.

When the side surface portion 30*b* of the flexible printed circuit 30 has passed away from the projected portion 20*f*, the flexible printed circuit 30 is further moved in the extraction direction while being guided by the flat portion 20*m* of the lock part 20 (see FIG. 12C) so as to be extracted through the insertion portion opening 24*a* (see FIG. 12D).

At this stage, the extraction of the flexible printed circuit 30 is completed.

Now, a description will be made to the effects of the embodiment of the invention.

As described above, the connector 10 according to this embodiment is configured such that the arm portion 20*b* of the lock part 20 has a cantilever shape with the stationary end 20*e* and the free end 20*k* and extends, in the depth direction orthogonal to the width direction, to the free end 20*k* from the insertion side portion 20*r* on the side from which the flexible printed circuit 30 is inserted. Furthermore, the arm portion 20*b* can be elastically deflected outward in the width direction. The projected portion 20*f* which is formed on the inner side portion of the arm portion 20*b* and protruded into the insertion portion 24 has the tilted portion 20*g* toward the free end and the tilted portion 20*i* toward the insertion side portion, the tilted portions 20*g* and 20*i* being tilted relative to the depth direction.

Thus, applying force to the flexible printed circuit 30 in the direction of insertion and extraction of the flexible printed circuit 30 at the time of the insertion and extraction causes the arm portion 20*b* to be deflected outward in the width direction by the tilted portion 20*g* toward the free end or the tilted portion 20*i* toward the insertion side portion of the projected portion 20*f* formed on the arm portion 20*b*, thereby facilitating insertion and extraction of the flexible printed circuit 30.

This eliminates the necessity of an additional conventional lock release operation, so that the flexible printed circuit 30 and the lock part 20 on the connector side will never be damaged even by performing an extraction operation without performing the lock release operation.

Furthermore, since a conventional lock release operation is not required, an operation portion for a lock release portion needs not to be provided on the upper portion of the connector, thereby enabling the connector to be reduced in height.

Thus, the connector 10 according to this embodiment is configured to facilitate insertion and extraction of the flexible printed circuit 30 and enable the connector 10 to be reduced in height without damaging the flexible printed circuit 30 and the lock part 20 on the connector side at the time of the insertion and extraction.

Furthermore, the connector 10 according to this embodiment is configured such that the arm portion 20*b* is curved in a U shape at the insertion side portion 20*r*. This configuration enables the stationary portion 20*a* of the lock part 20 to be disposed at a desired position in the depth direction, while ensuring the deflection elasticity of the arm portion 20*b*, by adjusting the length from the insertion side portion 20*r* to the stationary end 20*e*.

Furthermore, the connector 10 according to this embodiment is configured such that in the projected portion 20*f* of the lock part 20, the tilt angle $\alpha$ of the tilted portion 20*g* toward the free end relative to the depth direction is greater than the tilt angle $\beta$ of the tilted portion 20*i* toward the insertion side portion. This configuration enables the force required at the time of extraction of the flexible printed circuit 30 to be greater than the force required at the time of insertion. This implements a configuration which makes it easy to insert and hard to extract the flexible printed circuit 30.

Furthermore, the connector 10 according to this embodiment is configured such that both the lock parts 20 and 22 have outer shapes that are symmetric to each other. This configuration allows for manufacturing both the lock parts 20 and 22 by the same manufacturing facility, thereby reducing manufacturing costs.

Furthermore, the connector 10 according to this embodiment is configured such that both the lock parts 20 and 22 are made of a metal. This configuration provides an increased strength of the lock parts 20 and 22, so that the lock parts 20 and 22 will resist damage even when the insertion and extraction of the flexible printed circuit 30 are repeated.

Furthermore, the connector 10 according to this embodiment is configured such that the flexible printed circuit 30 is reinforced by the metal plate 34 including at least the notches 40 and 42. This configuration allows the flexible printed circuit 30 to resist damage caused by the insertion and extraction of the flexible printed circuit 30.

Another Embodiment

Now, a description will be made to a lock part according to another embodiment of the present invention.

FIGS. 13A to 13D illustrate four example modes of a lock part according to the other embodiment of the present invention.

Figure 13A:
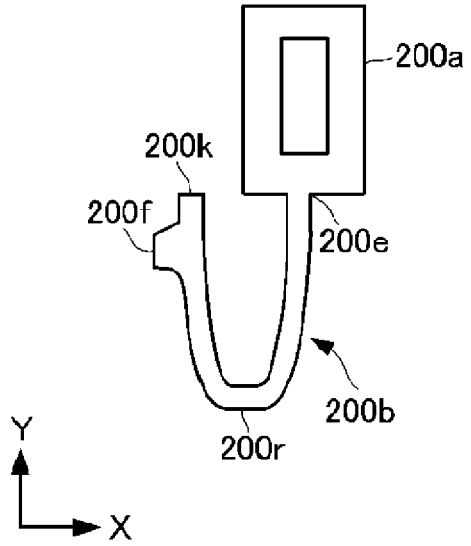
FIG. 13A is an explanatory view illustrating a lock part according to another embodiment of the present invention.

The example illustrated in FIG. 13A is a lock part that is curved in a U shape at an insertion side portion 200*r* and has generally the same length from the insertion side portion 200*r* to a free end 200*k* and to a stationary end 200*e*, with an arm portion 200*b* being formed generally in a U shape as a whole. The stationary end 200*e* is integrally coupled to a stationary portion 200*a*, which is located farther away from the arm portion 200*b* in the depth direction (in the Y-axis direction).

Figure 13B:
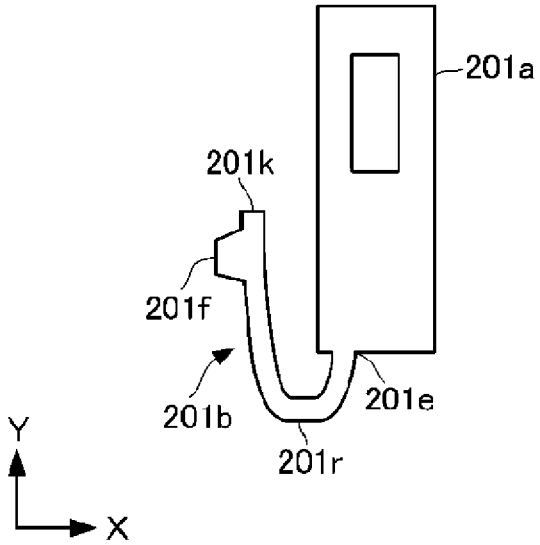
FIG. 13B is an explanatory view illustrating a lock part according to another embodiment of the present invention.

The example illustrated in FIG. 13B is a lock part that is curved in a U shape at an insertion side portion 201*r*, and has the length from the insertion side portion 201*r* to a free end 201*k* longer than the length from the insertion side portion 201*r* to a stationary end 201*e*.

Figure 13C:
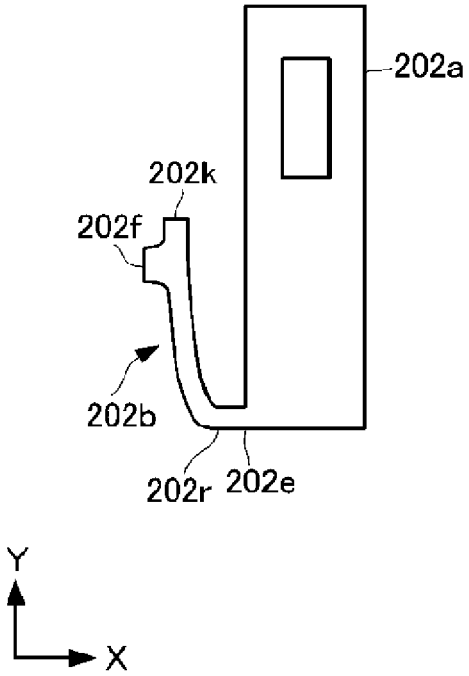
FIG. 13C is an explanatory view illustrating a lock part according to another embodiment of the present invention.

The example illustrated in FIG. 13C is a lock part in which a stationary end 202*e* is integrally coupled to a side surface toward the front end of a stationary portion 202*a* in the depth direction, and an arm portion 202*b* slightly extends from the stationary end 202*e* in the width direction and subsequently extends in the depth direction to a free end 202*k*. In this example, an insertion side portion 202*r* and the stationary end 202*e* are located generally at the same position or very close to each other.

Figure 13D:
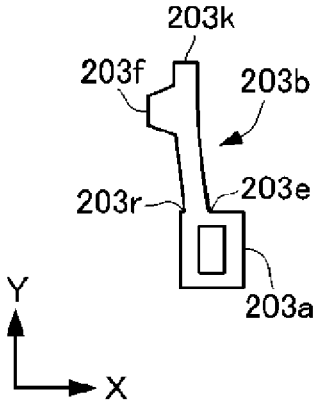
FIG. 13D is an explanatory view illustrating a lock part according to another embodiment of the present invention.

The example illustrated in FIG. 13D is configured such that a stationary portion 203*a* is located on the side from which the flexible printed circuit 30 is inserted, and a stationary end 203*e* is integrally coupled to a rear end of the stationary portion 203*a* in the depth direction. In this example, an insertion side portion 203*r* and the stationary end 203*e* generally coincide with each other.

In the examples illustrated in FIGS. 13A to 13D, the stationary ends 200*e*, 201*e*, 202*e*, and 203*e* of the arm portions can be coupled to the stationary portions 200*a*, 201*a*, 202*a*, and 203*a*, respectively, at an arbitrary position in the width direction (in the X-axis direction). On the other hand, as illustrated in FIG. 6, the stationary portion may also be constituted by the wide portion and the narrow portion so as to allow a deflected arm portion to be received by the narrow portion.

The insertion side portion of the embodiment of the present invention illustrated above is located, in the arm portion, on the side from which the flexible printed circuit is inserted. However, as illustrated in FIG. 13D, the embodiment of the present invention also encompasses the case where the insertion side portion and the stationary end are consistent with each other.

As described above, the embodiment of the present invention facilitates insertion and extraction of a flexible printed circuit and enables a connector to be reduced in height without damaging the flexible printed circuit and a lock part on the connector side at the time of the insertion and extraction, and is useful for connectors in general.

REFERENCE SIGNS LIST

10 connector
11 housing
12 frame
12*a* first frame
12*b* second frame
12*c* third frame
12*d* fourth frame
12*e* tilted surface
12*f* projected surface portion
12*g*, 12*i* projection
14 cover
14*a* upper plate portion
14*b*, 14*c* mounting portion
14*d* rear plate portion
16, 18 contact
16-1 to 16-12 first type contact
18-1 to 18-12 second type contact
16*a*, 18*a* contacting portion
16*b*, 18*b* bent portion
16*c*, 18*c* connection terminal portion
20, 22 lock part
20*a* stationary portion
20*b* arm portion
20*c* hole
20*d* recessed portion
20*e* stationary end
20*f*, 22*f* projected portion
20*g* tilted portion toward free end
20*h*, 20*j*, 20*m* flat portion
20*i* tilted portion toward insertion side portion
20*k* free end
20*n* guide portion
20*p* wide portion
20*q* narrow portion
20*r* insertion side portion
24 insertion portion
24*a* insertion portion opening
30 flexible printed circuit
30*a* top corner portion
30*b* side surface portion
30*c* corner of notch
32 printed circuit body
33 connection end portion
34 metal plate
35 conductor trace section
36, 38 connection terminal

36-1 to 36-12 connection terminal
38-1 to 38-12 connection terminal
40, 42 notch

The invention claimed is:

1. A connector comprising:

a housing having an insertion portion into which a flexible substrate is inserted; and a contact having a contacting portion to be in contact with a connection terminal of the flexible printed circuit having been inserted into the insertion portion, wherein a lock part for locking an inserted state of the flexible printed circuit having been inserted into the insertion portion is provided in the housing on both sides of the insertion portion in a width direction, each of the lock parts has an arm portion and a projected portion which is formed on an inner side portion of the arm portion in the width direction and protruded into the insertion portion, where the arm portion has a cantilever shape with a stationary end and a free end, extends, in a depth direction orthogonal to the width direction, to the free end from an insertion side portion on a side from which the flexible printed circuit is inserted, and can be elastically deflected outward in the width direction, the projected portion has a tilted portion toward the free end and a tilted portion toward the insertion side portion, the tilted portions being tilted relative to the depth direction, and is detachably engaged with a notch provided on a side of the flexible printed circuit in the width direction when the flexible printed circuit is an inserted state, the arm portion is curved in a U shape at the insertion side portion, the arm portion has a turned-back portion at the insertion side portion on the side from which the flexible printed circuit is inserted, the turned-back portion being between the stationary end and the free end and being curved in the U shape; and the turned-back portion of the arm portion is exposed from the housing at the insertion side portion on the side from which the flexible printed circuit is inserted.

2. The connector according to claim 1, wherein a tilt angle of the tilted portion toward the free end relative to the depth direction is greater than a tilt angle of the tilted portion toward the insertion side portion.

3. The connector according to claim 1, wherein both the lock parts have outer shapes that are symmetric to each other.

4. The connector according to claim 1, wherein both the lock parts are made of a metal.

5. The connector according to claim 1, wherein the flexible printed circuit is reinforced by a metal plate including at least the notch.

* * * * *